US005178302A

United States Patent [19]

Cheng

[11] Patent Number: 5,178,302

[45] Date of Patent: Jan. 12, 1993

[54] TOOTH PASTE SQUEEZING DEVICE WITH A SPRING BIASED ROLLER ASSEMBLY

[76] Inventor: Kweng-Ming Cheng, No. 257-2, Wuhua Street, Sanchung City, Taiwan

[21] Appl. No.: 816,644

[22] Filed: Jan. 2, 1992

[51] Int. Cl.[5] ..... B65D 35/28

[52] U.S. Cl. ..... 222/102; 222/105

[58] Field of Search ..... 222/101, 102, 106, 105

[56] References Cited

U.S. PATENT DOCUMENTS

| | | | |
|---|---|---|---|
| 1,866,190 | 7/1932 | Dazey | 222/102 X |
| 2,185,775 | 1/1940 | Ryba | 222/102 X |
| 2,690,858 | 10/1954 | Peralta et al. | 222/102 X |
| 2,932,431 | 4/1960 | Lipton | 222/102 X |
| 5,118,011 | 6/1992 | Kopp | 222/102 |

FOREIGN PATENT DOCUMENTS

| | | | |
|---|---|---|---|
| 446239 | 1/1948 | Canada | 222/102 |

*Primary Examiner*—Gregory L. Huson

*Attorney, Agent, or Firm*—Ostrolenk, Faber, Gerb & Soffen

[57] ABSTRACT

A tooth paste squeezing device comprising a frame attachable to a wall or a support, on which a pair of matched rollers having toothed surfaces engageable with each other are slidably mounted. A rotatable knob is secured on one of the rollers to rotate it and the rotation is transmitted to the other roller via a gear train so that when a tooth paste tube is inserted between the rollers and the knob is rotated to rotate the rollers, the tooth paste is squeezed out of the tube.

7 Claims, 3 Drawing Sheets

TOOTH PASTE SQUEEZING DEVICE WITH A SPRING BIASED ROLLER ASSEMBLY

FIELD OF THE INVENTION

The invention relates generally to a device for squeezing tooth paste.

BACKGROUND OF THE INVENTION

People usually squeeze tooth paste randomly from anywhere on the tooth paste tube, thus resulting in a randomly and irregularly deformed tooth paste tube. Sometimes, the tooth paste tube is broken or torn due to such a randomly squeezing action and the tooth paste leaks therefrom and produces an untidy condition.

A prior art tooth paste squeezer has therefore been developed. A conventional tooth paste tube usually has an end permanently sealed and an open end closed with a cap. The prior art squeezer squeezes tooth paste by winding a tooth paste tube from the sealed end thereof toward the capped end. The disadvantage of the prior art squeezer is that it is incapable of completely squeezing all of the tooth paste out of the tube due to the clearance between the windings of the tube.

It is therefore desirable to have a tooth paste squeezing device that not only starts squeezing tooth paste from the sealed end of the tooth paste tube, but is also helpful in completely squeezing the tooth paste out of a tooth paste tube.

OBJECTS OF THE INVENTION

It is an object of the present invention to provide a tooth paste squeezing device which is capable of squeezing tooth paste out of a tooth paste tube from the sealed end of the tooth paste tube.

It is another object of the present invention to provide a tooth paste squeezing device which is capable of completely squeezing tooth paste from a tooth paste tube except for the portion in the vicinity of the capped end of the tube.

To achieve the above-mentioned objects, there is provided a tooth paste squeezing device comprising a frame attached to a fixture, on which a pair of matched rollers having toothed surfaces engageable with each other are slidably mounted. A rotatable knob is secured on one of the rollers to rotatable it and the rotation is transmitted to the other roller via a gear train so that when a tooth paste tube is inserted between the rollers and the knob is rotated to rotate the rollers, the tooth paste is squeezed out of the tube.

Other objects and advantages of the invention will be apparent from the following description of the preferred embodiment taken in connection with the accompanying drawing wherein:

DETAILED DESCRIPTION OF THE PREFERRED EMBODIMENT

Figure 1:
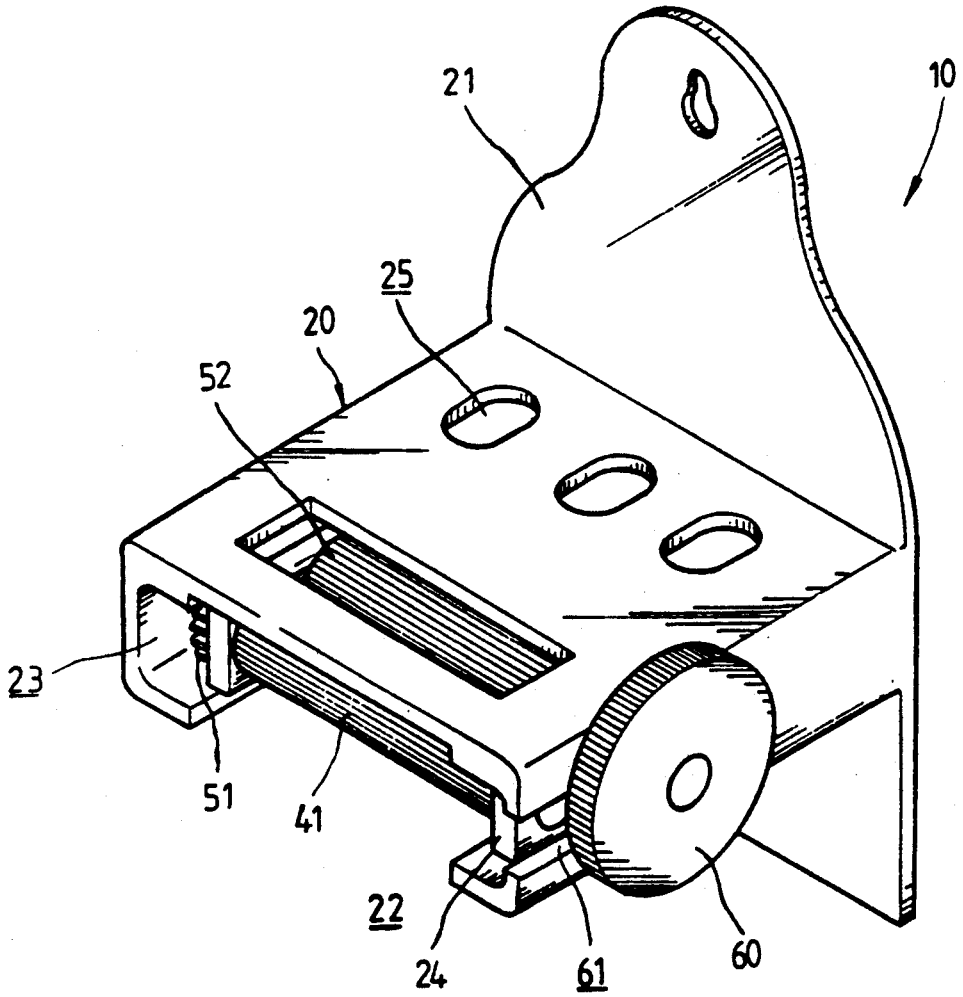
FIG. 1 is a perspective view of a tooth paste squeezing device in accordance with the present invention.
Figure 2:
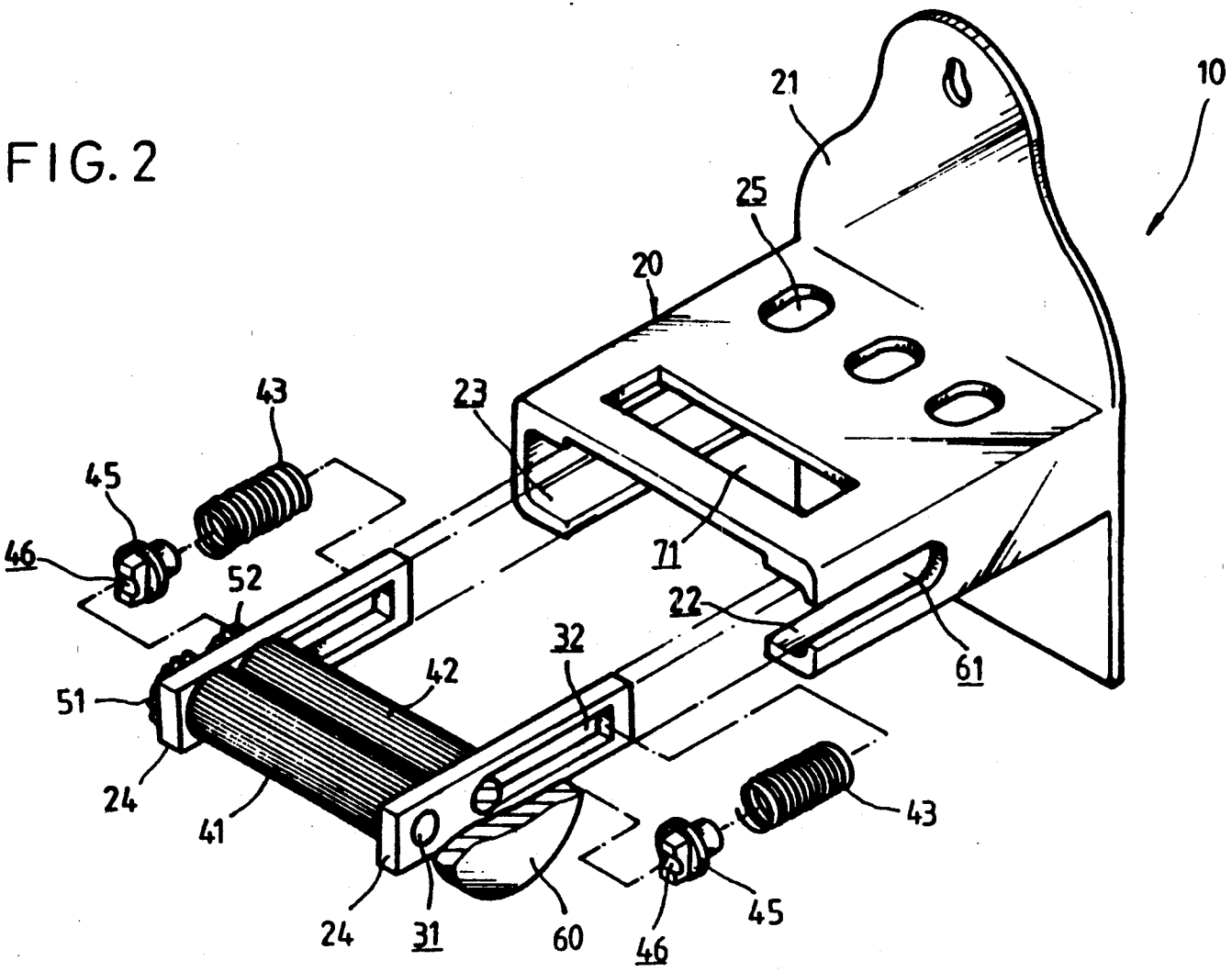
FIG. 2 is an exploded perspective view of the tooth paste squeezing device shown in FIG. 1.

With reference to the drawings and in particular to FIGS. 1 and 2, a tooth paste squeezing device in accordance with the present invention, generally designated with the reference numeral 10, comprises a frame 20, which has preferably attached thereon hanging means 21 for hanging the device 10 on a wall of or a support in a bath room (not shown). Other securing means for securing the tooth paste squeezing device 10 to the bath room wall or other supports is also applicable. The frame 20 defines a first guiding slot 22 and a second guiding slots 23 opposing each other, with a sliding member 24 slidably mounted in each thereof. The frame 20 also defines a plurality of holes 25 for receiving therein tooth brushes (not shown).

Each of the sliding members 24 is in the form of a plate with a hole 31 and an elongated slot 32 generally extending in the length of the plate, i.e. the longitudinal direction of the guiding slots 22 and 23, formed thereon. A first roller 41, preferably with a toothed surface, is mounted between the sliding members 24 with the ends thereof in the holes 31 of the sliding members 24 so that the first toothed roller 41 is rotatable about an axis running through the centers of the holes 31. A second roller 42, preferably with a toothed surface, is also mounted between the sliding members 24 with the ends thereof in the elongated slots 32 of the sliding members 24.

The second toothed roller 42 is biased by two springs 43, each of which has an end fixed on a member immovable with respect to said rollers, preferably on the sliding member 24, and an end mounted on a retainer 45 which has a recess 46 to engage with a smooth portion of the second toothed roller 42, to engageably contact the first toothed roller 41.

A first gear 51 is secured on one end of the first toothed roller 41 to be rotatable therewith and a second gear 52 is secured on one end of the second toothed roller 42 to be rotatable therewith. With the biasing force produced by the springs 43, the first gear 51 and the second gear 52 are engageable with each other so that the rotation of the second toothed roller 42 is transmitted to the first toothed roller 41.

A rotatable knob 60 is attached to one of the first toothed roller 41 and the second toothed roller 42. In the embodiment shown in the drawing, the knob 60 is attached to the second toothed roller 42. To accommodate the installation of the rotatable knob 60, a further slot 61 is formed on the guide slot 22.

Figure 3:
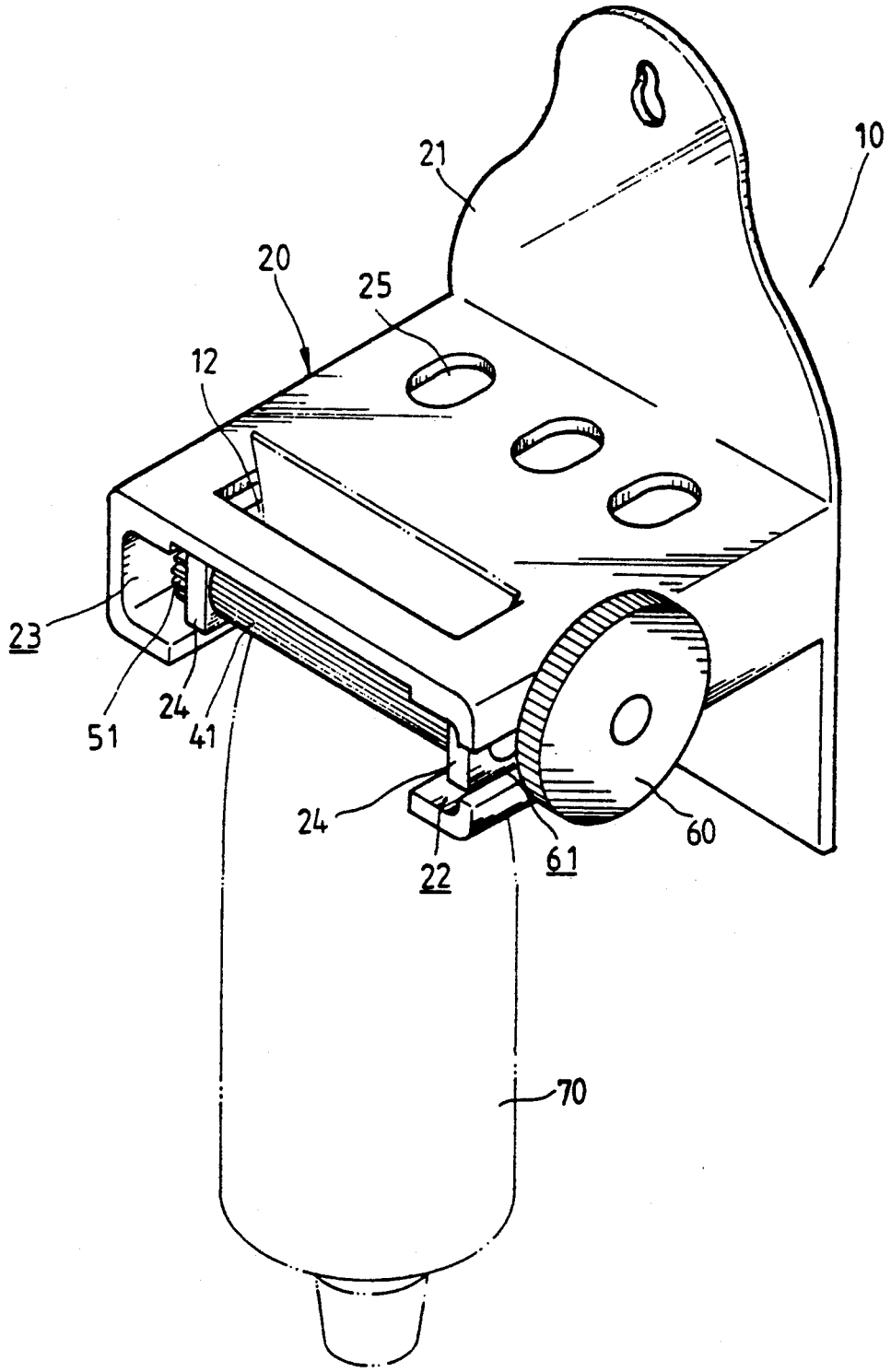
FIG. 3 is a perspective view showing a tooth paste tube squeezed with the tooth paste squeezing device of the present invention.

With the rotation of the knob 60, the second toothed roller 42 is rotated and then the first toothed roller 41 follows via the gears 51 and 52. The contact between the toothed rollers 41 and 42 resulted from the biasing force of the springs 43 leaves a very small gap therebetween to just allow a tooth paste tube 70 to pass between the toothed rollers 41 and 42 the tooth paste tube 70 then passes through a slot 71 which is defined on the frame 20 opposite where the toothed rollers 41 and 42 contact each other, as shown in FIG. 3. In operation, when the knob 60 is rotated, the rollers 41 and 42 rotate, compressing the tube 70 and squeezing the tooth paste out of the tube 70.

It is apparent that although the invention has been described in connection with the preferred embodiment, it is contemplated that those skilled in the art may make changes to certain features of the preferred embodiment without altering the overall basic function and concept of the invention and without departing from the spirit and scope of the invention as defined in the appended claims.

What is claimed is:

1. A tooth paste squeezing device, comprising: a frame having a first guiding slot and a second guiding slot; first and second sliding members, each of which is slidably disposed in one of the first and the second guiding slots, first and second rollers, each of the sliding members having an elongated slot extending generally in parallel with the guiding slots formed on said frame to respectively receive therein an end of one of the first and the second rollers, and a hole formed thereon for respectively receiving therein an end of the other one of the first roller and the second roller so that the rollers are rotatably mounted on the first and second slidable members with a gap therebetween for passing a tooth paste tube therethrough, said one of the rollers being slidable within said elongated slots toward said other one of the rollers, said one of the rollers having biasing means attached thereto to urge said one of the rollers toward said other one of the rollers, transmitting means connected between the rollers to transmit rotation therebetween, said transmitting means including a gear train comprising a first gear secured to the first roller to be rotatable therewith and a second gear secured to the second roller to be rotatable therewith, said first gear being engageable with said second gear when said one of the rollers is urged toward said other one of the rollers, and actuating means attached to at least one of the rollers to rotate the rollers.

2. A tooth paste squeezing device as claimed in claim 1 wherein said biasing means is a number of springs, each of which has a first end fixed on one of the sliding members and a second end mounted on a retainer having a recess which engages with a smooth portion formed on said one of the rollers.

3. A tooth paste squeezing device as claimed in claim 2 wherein the number of the biasing springs is two and the retainer of each of the biasing springs is located in the vicinity of an end of said one of the rollers.

4. A tooth paste squeezing device as claimed in claim 1 wherein said frame comprises attaching means for attaching said toothpaste squeezing device to a wall or a support.

5. A tooth paste squeezing device as claimed in claim 4 wherein said attaching means is a hanger for hanging said tooth paste squeezing device on a wall or a support.

6. A tooth paste squeezing device as claimed in claim 1 wherein said frame defines a plurality of holes for receiving therein tooth brushes.

7. A tooth paste squeezing device as claimed in claim 1, wherein the actuating means comprises a knob.

* * * * *